United States Patent [19]

Hosking et al.

[11] Patent Number: 4,772,005

[45] Date of Patent: Sep. 20, 1988

[54] SHEET FEEDING APPARATUS

[75] Inventors: Steven M. Hosking, Hants; Harvey G. Martin, Sussex, both of England

[73] Assignee: De La Rue Systems Limited, London, England

[21] Appl. No.: 702,723

[22] Filed: Feb. 19, 1985

[30] Foreign Application Priority Data

Feb. 20, 1984 [GB] United Kingdom ..... 8404363

[51] Int. Cl.[4] ..... B65H 3/44

[52] U.S. Cl. ..... 271/9; 271/10; 271/116

[58] Field of Search ..... 271/9, 10, 110, 111, 271/114, 116

[56] References Cited

U.S. PATENT DOCUMENTS

| | | | |
|---|---|---|---|
| 3,756,586 | 9/1973 | Craft | 271/9 |
| 4,248,415 | 2/1981 | Steinhilber | 271/9 |
| 4,434,359 | 2/1984 | Watanabe | 271/9 X |
| 4,522,382 | 6/1985 | Chu | 271/9 X |
| 4,524,268 | 6/1985 | Fukatsu | 271/9 X |

FOREIGN PATENT DOCUMENTS

| | | | |
|---|---|---|---|
| 3317910 | 12/1983 | Fed. Rep. of Germany . | |
| 2338882 | 8/1977 | France . | |
| 166239 | 10/1982 | Japan | 271/9 |
| 2073711 | 10/1981 | United Kingdom . | |

*Primary Examiner*—Richard A. Schacher

*Attorney, Agent, or Firm*—Cushman, Darby & Cushman

[57] ABSTRACT

Sheet feeding apparatus for use in a cash dispenser comprises two withdrawal systems (7,8) operated by a stepper motor (5) to withdraw sheets from respective cassettes (1,2). A transport system (17) operated by a continuously driven drive motor (16) receives sheets from the withdrawal systems (7,8) and transports them to an output station (28). The arrangement is such that in use the transport system (17) is continuously driven by the drive motor (16) and the withdrawal systems (7,8) are selectively driven by the stepper motor (5) during a transaction.

9 Claims, 2 Drawing Sheets

SHEET FEEDING APPARATUS

The invention relates to sheet feeding apparatus for feeding sheets, such as banknotes, vouchers and the like from one or more stores to an output station.

Sheet feeding apparatus is commonly used in cash dispensers for dispensing a selected quantity of banknotes from one or more stores, typically cassette stores, to a present outlet. A complex transport system is required to transport the sheets along preselected paths either to the present outlet or to a reject outlet after the banknotes have been tested for singularity. Typically, the transport system is driven by a common drive motor through an electromagnetic clutch which is actuated only in response to an operator request. The large amount of use of the clutch leads to considerable strain and there is a high probability of breakdown, especially with high speed dispensers.

Sheet feeding apparatus in accordance with the present invention for feeding sheets from one or more stores to an output station comprises a withdrawal system operated by a first drive to withdraw sheets from one or each store; and a transport system operated by a second drive to receive sheets from the withdrawal system and transport them to the output station, the arrangement being such that in use the transport system is continuously driven by the second drive and the withdrawal system is selectively driven by the first drive during a transaction.

This sheet feeding apparatus reduces the probability of breakdown in withdrawing sheets from the stores by separating the overall transport of sheets from the stores to an output station into two parts. Firstly, a withdrawal system which preferably defines a short path to withdraw sheets from the or each store and to feed them to a transport system which transports sheets to the output station. The transport system is continuously driven during a transaction thus reducing the strain on the second drive while the comparatively simple withdrawal system is driven intermittently to withdraw the specified quantity of sheets.

Preferably, the first drive comprises a stepper motor.

Where two stores are provided, the first drive is preferably reversable and the withdrawal system includes at least one pair of single direction freewheel clutches arranged to enable sheets to be withdrawn from one of the stores when the first drive operates in a first direction and from the other of the stores when the first drive operates in the other direction.

In the past, vacuum feed systems have been used for transporting sheets. These vacuum systems are generally reliable for banknotes which are non-porous. However, they are not so reliable for porous sheets such as vouchers and furthermore cannot achieve high feed speeds.

Conveniently, therefore the transport and/or withdrawal systems more sheets from the or each store to the output station under the influence of friction. This is conveniently achieved with the use of cooperating endless belts and cooperating rollers. It is particularly convenient if the withdrawal system comprises one or more feed rollers, and the transport system comprises a plurality of cooperating endless belts.

With friction feed systems, feed rates of up to 20 sheets per second can be achieved.

Preferably, the sheet feeding apparatus further comprises sheet detecting means for detecting the passage of sheets through the transport system. This sheet detection means is used to detect the passage of single sheets to indicate to a control system that a sheet has been fed. The detection means may additionally detect the passage of two or more sheets simultaneously thus indicating an incorrect feed and enabling diverting means in the transport system to be activated to divert the incorrectly fed sheets to a reject outlet.

Preferably, the sheet detection means is positioned at a leading end of the transport system. This is particularly useful where conventional solenoid actuated diverters are used in order to leave as much time between detection of the incorrectly fed sheets and the time at which sheets reach the diverter.

The "output station" referred to above may constitute an outlet opening to which the sheets are fed or it may be an intermediate position at which sheets are fed from the transport system to another transport system.

An example of sheet feeding apparatus in accordance with the present invention will now be described with reference to the accompanying drawings, in which.

Figure 1:
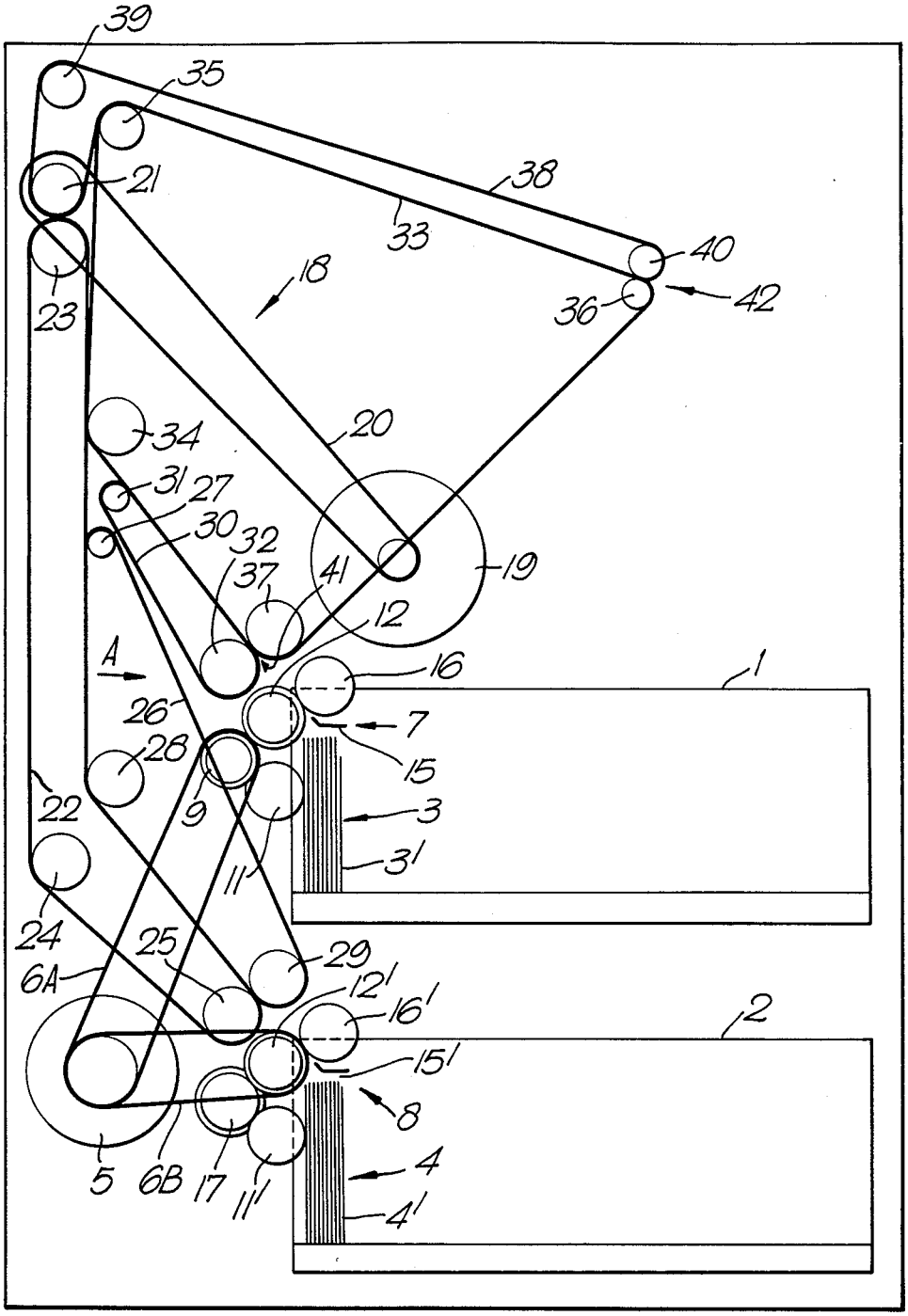
FIG. 1 is a schematic diagram of the apparatus.

The sheet feeding apparatus shown in FIG. 1 may form part of a cash dispenser having two cassettes 1, 2 each of which stores banknotes 3, 4 of different denominations. A stepping motor 5 (such as a Sonceboz 6191R008) actuates via endless drive belts 6A, 6B a pair of withdrawal systems 7,8. The withdrawal system 7 comprises a drive gear 9 engaging the drive belt 6A. The drive gear 9 engages gears 10A, 10B (FIG. 2) which are connected via clutches to be described below to a pair of shafts 13,14 on which are mounted non-rotatably two pairs of feed rollers 11, 12 respectively. The feed rollers 11 protrude through a window (not shown) in the cassette 1 to engage the stack of banknotes 3. The banknotes 3 are urged in a conventional manner towards the feed rollers 11 by a spring biased plate 3'. Rotation of the feed roller 11 in an anti-clockwise direction forces single banknotes from the stack 3 upwardly, as seen in the drawing, where they are guided by a guide surface 15 into the nips between the feed rollers 12 and contra-rotating rollers 16 (only one of which is shown in FIG. 1). The purpose of the contra-rotating rollers 16 is to prevent the feeding of two or more notes simultaneously. The rollers 16 could, however, be non-rotatably fixed.

The withdrawal system 8 is similar to the withdrawal system 7 with similar parts being given similar reference numerals with the addition of a prime. In this case, however, the feed roller 12' is driven by the stepper motor 5 via the drive belt 6B. This feed roller 12' is connected via a gear and clutch (to be described below) with a drive gear 17. The drive gear 17 engages a feed roller 11' via a clutch to be described below. Banknotes from the cassette 2 are guided by a guide plate 15' into the nips between the feed rollers 12' and contra-rotating rollers 16'. As with the rollers 16, the rollers 16' could be non-rotatably fixed.

Figure 2:
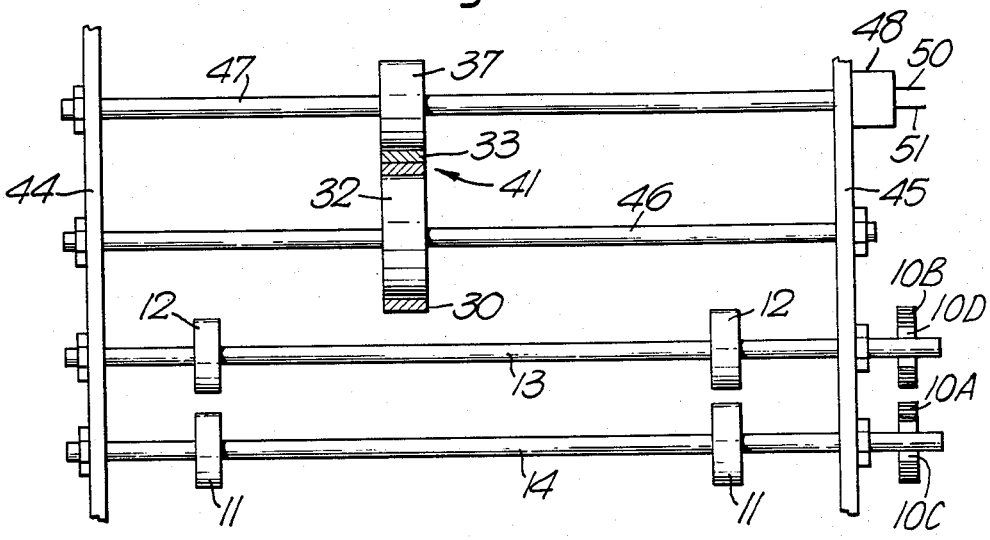
FIG. 2 illustrates a portion of the apparatus as seen in the direction A in FIG. 1 with some parts omitted for clarity; and, FIG. 3 is a block diagram of the control apparatus.
Figure 3:
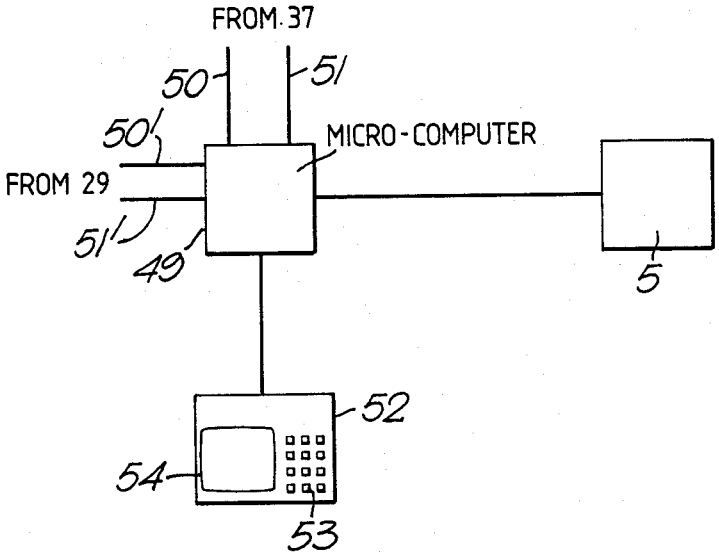

The feed rollers 11, 12, 11' and 12' contain single direction freewheel clutches (two of which 10C, 10D are shown in FIG. 2) such as Torrington clutches arranged so that when the stepping motor 5 rotates in a clockwise direction, as seen in the drawing, banknotes are withdrawn only from the cassette 1 while the feed rollers 11', 12' are not driven. Conversely, banknotes are withdrawn only from the cassette 2 when the stepping motor 5 is driven in an anti-clockwise direction while the rollers 11, 12 are not driven.

This use of single direction freewheel clutches allows the control system to be described below to select from which cassette 1, 2 banknotes are withdrawn simply by controlling the direction of rotation of the stepper motor 5.

The withdrawal systems 7, 8 feed banknotes from the respective cassettes 1, 2 into a transport system 18. The transport system 18 comprises a drive motor 19 (such as an Electrolux MO56 MX2) which continuously drives the transport system during a transaction via a drive belt 20. The drive belt 20 is entrained around a drive wheel 21. The drive motor 19 also drives the contra-rotating rollers 16, 16' via a drive system not shown. The transport system 18 further comprises an endless belt 22 entrained around idler rollers 23, 24, 25; an endless belt 26 entrained about idler rollers 27, 28, and 29; an endless belt 30 entrained around idler rollers 31, 32; an endless belt 33 entrained about idler rollers 34, 35, 36, and 37; and an endless belt 38 entrained around the drive wheel 21 and idler rollers 39, 40.

The entire transport system is driven via the drive wheel 21 under the influence of friction contact between adjacent endless belts.

The idler rollers 32, 37 define a nip 41 into which banknotes from the cassette 1 are fed by the withdrawal system 7. At this position, the banknotes are transferred from the withdrawal system 7 to the transport system 18 which carries the banknotes along a path defined by the endless belts 30, 33; 22,33; and 38, 33 to an output station 42. In its simplest form, the output station 42 comprises a present outlet but in other examples (not shown) banknotes may be transferred to another path which feeds more than one output station or can transfer banknotes to a reject outlet in a known manner.

It should be understood that all the rollers and drive wheels illustrated in FIG. 1 are mounted on respective shafts supported in a housing of the cash dispenser. For simplicity, these shafts have been omitted in FIG. 1 but some are illustrated in FIG. 2 being mounted in internal walls 44, 45 of the cash dispenser. The shafts 13, 14 are rotatably mounted in the walls 44, 45. The idler roller 32 is rotatably mounted on a shaft 46 which itself is non-rotatably mounted between the walls 44, 45. The idler roller 37 is rotatably mounted on a shaft 47 which is non-rotatably mounted between the walls 44, 45. The idler roller 37 constitutes part of a banknote detection system for detecting the passage of one or more banknotes through the nip 41. This detection system may comprise any known system such as an inductive system in which the shaft 47 is supported in a floating plastics bearing contained within a box 48 supporting an inductive sensor of a conventional type (not shown). The shaft 47 is urged towards the shaft 46 by a spring within the box 48 so that the endless belts 30, 33 are maintained in engagement with one another to define the nip 41. When a banknote passes through the nip 41 the shaft 47 will be urged away from the shaft 46 and this will cause the inductive sensor to output a voltage signal via leads 50,51 to a controlling microcomputer 49 (such as an INTEL 8031).

An alternative detection system which would also be suitable is described in EP-A-No. 0130824 which also provides a voltage output related to the separation between the idler rollers 37, 32.

A similar detection system is associated with the withdrawal system 8 in which the idler roller 29 is equivalent to the idler roller 37. Output signals are fed to the microcomputer 49 via leads 50',51'.

An operator console 52 is positioned adjacent the present outlet which may be defined by the output station 42 and in use an operator enters the amount of cash he wishes to withdraw via a key pad 53 on the console 52. This amount will be displayed on a monitor 54. The microcomputer 49 is connected to the console 52 and determines the quantities of banknotes which must be withdrawn from each cassette to fulfil the operators request. The microcomputer 49 then actuates the drive motor 19 and controls the stepper motor 5 accordingly.

For example, if the operator requests eleven pounds sterling and the cassette 1 contains one pound notes and the cassette 2 five pound notes it will be necessary to deliver two banknotes from the cassette 2 and one banknote from the cassette 1. To achieve this, the steppe motor 5 is firstly rotated in an anti-clockwise direction which causes anti-clockwise rotation of the feed roller 12' since the single direction clutch is actuated, clockwise rotation of the drive gear 17 and hence anti-clockwise direction of the feed roller 11'. The clutches 10C, 10D will freewheel. This movement draws a banknote out of the cassette 2 and feeds it into the nip between the idler rollers 25, 29 of the transport system 18. The banknote is then fed by the transport system which is continuously driven by the motor 19 to the output station 42. As soon as the detection system associated with the idler roller 29 detects that a banknote has passed the nip between the rollers 25, 29, the microcomputer 49 causes the stepper motor 5 to stop. Since two banknotes are required from the cassette 2 the microcomputer restarts the stepper motor 5, after a short delay, and it again rotates in an anti-clockwise direction to draw a second banknote from the cassette 2 which is fed to the output station 42 in a similar manner. To complete the transaction, the microcomputer 49 then causes the stepper motor 5 to rotate in a clockwise direction which causes clockwise rotation of the drive gear 9 and hence anti-clockwise rotation of the feed rollers 11, 12 since the corresponding single direction clutches 10C, 10D are actuated. The other clutches will freewheel. Again, rotation of the stepper motor 5 causes a single banknote to be drawn from the cassette 1 and passed into the nip 41. This banknote is then passed by the transport system 18 to the output station 42 in a similar manner. Once the detection system associated with the idler roller 38 has determined that the banknote has passed into the nip 41, it causes the microcomputer 49 to stop the stepper motor 5.

It will be seen therefore that the stepper motor 5 is only intermittently actuated to draw the correct quantities of banknotes from the cassettes 1, 2. Conversely, the drive motor 19 is continuously driven in one direction during the transaction.

If a banknote is not detected entering the transport system after a predetermined interval, the microcomputer 49 stops the stepper motor 5 and the drive motor 19. This may happen when a cassette is empty or a jam has occurred.

As has been mentioned above, a more complex feed system may be provided to deal with the feeding of incorrect banknotes for example two or more banknotes simultaneously. In this case, the output station 42 will be associated with a further feed path and one or more diverters controlled by the microcomputer 49 to divert incorrect banknotes to a reject station.

The detection systems associated with the idler rollers 29, 37 can also be used to count banknotes fed into the transport system 18.

In a further refinement, since a certain amount of misalignment and wear can occur between the rollers 25, 29 and 32, 37 it is convenient if output signals from the detection systems are monitored just prior to the feeding of a banknote to enable the microcomputer 49 to compensate for any wear. This is more fully described in EP-A-No. 0130825.

We claim:

1. Sheet feeding apparatus comprising:

at least one sheet store for storing a stack of sheets;

an output station;

first and second drives;

first and second sheet stores;

a withdrawal system operated by said first drive to withdraw sheets from said sheet store said withdrawal system being adapted to continuously engage said stack of sheets in said store, said withdrawal system having, at least one feed roller associated with each of said stores, a common drive motor, and at least two single direction free wheel clutches with said feed rollers being driven by said common drive motor via said single direction free wheel clutches operating with at least one of said clutches being engaged in response to rotation of said drive motor in one direction, at least one of said clutches being engaged upon rotation of said drive motor in an opposite direction enabling said sheets to be selectively withdrawn from said first store in response to said one direction of rotation of said drive motor and from said second store in response to said opposite direction of rotation of said drive motor; and a transport system including said second drive receiving said sheets from said withdrawal system and said second drive transporting said sheets to said output station, said transport system being continuously driven by said second drive and said withdrawal system being selectively driven at least once by said first drive during a transaction operation whereby each time said withdrawal systems is driven a single sheet is withdrawn from one of said stores and fed to said transport system.

2. Sheet feeding apparatus according to claim 1, wherein said first drive comprises a stepper motor.

3. Sheet feeding apparatus according to claim 1, wherein said at least one of said transport and said withdrawal system is adapted to move sheets from said at least one store to said output station under the influence of friction.

4. Sheet feeding apparatus according to claim 3, wherein said withdrawal system comprises a plurality of feed rollers, and said transport system comprises a plurality of cooperating endless belts.

5. Sheet feeding apparatus according to claim 1, further comprising sheet detection means for detecting the passage of sheets through said transport system.

6. Sheet feeding apparatus according to claim 5, wherein said transport system defines a leading end, and said sheet detection means is positioned at said leading end of said transport system.

7. Sheet feeding apparatus according to claim 1, wherein said common drive motor comprises a stepper motor.

8. Sheet feeding apparatus according to claim 1, said apparatus further including a plurality of sheet stores for storing respective stacks of sheets, said withdrawal system being adapted to continuously engage the stacks of sheets in each of said stores and, when driven, to withdraw a single sheet from a selected one of said stores and to feed said withdrawn sheet to said transport system.

9. Banknote feeding apparatus comprising first and second banknote stores for storing respective stacks of banknotes;

an output station;

first and second drives;

a withdrawal system including at least one feed roller associated with each said store and being adapted to continuously engage said respective stack of banknotes, and at least two single direction freewheel clutches, said feed rollers being driven by said first drive via said single direction freewheel clutches operating with at least one of said clutches being engaged in response to rotation of said first drive in one direction and at least one of said clutches being engaged upon rotation of said drive in an opposite direction, said banknotes being selectively withdrawn from said first or said second stores in response to the direction of rotation of said first drive; and a transport system including said second drive receiving said banknotes from said withdrawal system and said second drive transporting said banknotes to said output station, said transport system being continuously driven by said second drive and said withdrawal system being selectively driven at least once by said first drive during a transaction operation whereby each time said withdrawal system is driven a single banknote is withdrawn from one of said stores and fed to said transport system.

* * * * *